US006475404B1

(12) United States Patent
Carlson

(10) Patent No.: US 6,475,404 B1
(45) **Date of Patent: *Nov. 5, 2002**

(54) INSTANT MAGNETORHEOLOGICAL FLUID MIX

(75) Inventor: J. David Carlson, Cary, NC (US)

(73) Assignee: Lord Corporation, Cary, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/564,169

(22) Filed: May 3, 2000

(51) Int. Cl.[7] ..... H01B 1/44

(52) U.S. Cl. ..... 252/62.62; 252/62.53; 252/62.54; 252/62.55

(58) Field of Search ..... 252/62.52, 62.53, 252/62.55, 62.54

(56) References Cited

U.S. PATENT DOCUMENTS

| | | | | | |
|---|---|---|---|---|---|
| 2,575,360 | A | | 11/1951 | Rabinow | 192/21.5 |
| 2,661,825 | A | | 12/1953 | Winslow | 192/21.5 |
| 2,886,151 | A | | 5/1959 | Winslow | 192/21.5 |
| 5,382,373 | A | | 1/1995 | Carlson et al. | 252/62.52 |
| 5,531,922 | A | * | 7/1996 | Okinaka et al. | 252/62.56 |
| 5,578,238 | A | | 11/1996 | Weiss et al. | 252/62.52 |
| 5,599,474 | A | | 2/1997 | Weiss et al. | 252/62.52 |
| 5,609,788 | A | * | 3/1997 | Deetz | 252/62.54 |
| 5,645,752 | A | * | 7/1997 | Weiss et al. | 252/62.52 |
| 5,670,077 | A | * | 9/1997 | Carlson et al. | 252/62.52 |
| 5,683,615 | A | | 11/1997 | Munoz | 252/62.52 |
| 5,705,085 | A | | 1/1998 | Munoz et al. | 252/62.52 |
| 5,900,184 | A | | 5/1999 | Weiss et al. | 252/62.52 |
| 5,906,767 | A | | 5/1999 | Karol et al. | 252/62.52 |
| 6,132,633 | A | * | 10/2000 | Carlson | 252/62.52 |
| 6,203,717 | B1 | * | 3/2001 | Munoz et al. | 252/62.52 |

* cited by examiner

*Primary Examiner*—C. Melissa Koslow
(74) *Attorney, Agent, or Firm*—Miles B. Dearth

(57) ABSTRACT

Magnetorheological fluid concentrates are provided which contain a substantially dry mixture of magnetic-responsive powder and a thixotropic agent. The concentrates may be mixed with an aqueous or an organic carrier fluid to form magnetorheological fluids.

26 Claims, No Drawings

INSTANT MAGNETORHEOLOGICAL FLUID MIX

FIELD OF THE INVENTION

The invention relates to mixtures of dry powders that form functional magnetorheological fluids when a carrier fluid is added to the mixtures. These magnetorheological fluids exhibit substantial increases in flow resistance when exposed to magnetic fields.

BACKGROUND OF THE INVENTION

Magnetorheological fluids are fluid compositions that undergo a change in apparent viscosity in the presence of a magnetic field. The fluids typically include ferromagnetic or paramagnetic particles dispersed in a carrier fluid. The particles become polarized in the presence of an applied magnetic field, and become organized into chains of particles within the fluid. The particle chains increase the apparent viscosity (flow resistance) of the fluid. The particles return to an unorganized state when the magnetic field is removed, which lowers the viscosity of the fluid.

Magnetorheological fluids have been proposed for controlling damping in various devices, such as dampers, shock absorbers, and elastomeric mounts. They have also been proposed for use in controlling pressure and/or torque in brakes, clutches, and valves. Magnetorheological fluids are considered superior to electrorheological fluids in many applications because they exhibit higher yield strengths and can create greater damping forces.

Some of the first magnetorheological fluids, described, for example, in U.S. Pat. Nos. 2,575,360, 2,661,825 and 2,886,151, included reduced iron oxide powders and low viscosity oils. These mixtures tend to settle as a function of time, with the settling rate generally increasing as the temperature increases. One of the reasons why the particles tend to settle is the large difference in density between the oils (about 0.7–0.95 g/cm$^3$) and the metal particles (about 7.86 g/cm$^3$ for iron particles). The settling interferes with the magnetorheological activity of the material due to non-uniform particle distribution. Often, it requires a relatively high shear force to re-suspend the particles.

A limitation of these magnetorheological fluids is that they are prepared with organic carrier fluids, such as oils, which can become polymerized, degrade, promote growth of bacteria and be flammable. In addition, organic carrier fluids can be incompatible with components of the device in which it is used.

To avoid the disadvantages of oil-based magnetorheological fluids, some attempts have been made to prepare magnetorheological fluids that do not include organic carrier fluids or which only include water-miscible organic solvents. Prior attempts at preparing water-based magnetorheological fluids used various thickening agents, such as xanthan gum and carboxymethyl cellulose as described in U.S. Pat. No. 5,670,077. However, these formulations can be difficult to mix, tend to exhibit clumping problems and tend to settle over time. Moreover, both oil-based and water-based magnetorheological fluids have the disadvantage of being bulky in transit, causing high transportation costs.

Thus, it would be advantageous to have a magnetorheological fluid which avoids the problems of the prior art, is easy to transport and is stable both during transport and after the magnetorheological fluid is put to use. It further would be advantageous to have a magnetorheological fluid which can be easily mixed and will not settle over time. It also would be advantageous to have a product which can be easily shipped to the end user. The present invention provides such a product.

SUMMARY OF THE INVENTION

The present invention provides a mixture of components that will form a magnetorheological fluid when a carrier fluid is added. The carrier fluid may be an aqueous or an organic fluid. The mixture of components utilized is substantially dry and comprises magnetic-responsive powder and a thixotropic agent. This mixture provides an instant magnetorheological fluid mix or concentrate which can be shipped and stored in powder form until the user is ready to form a magnetorheological fluid. A magnetorheological fluid of the present invention is comprised of the magnetorheological fluid concentrate and an aqueous fluid or an organic fluid. In a preferred embodiment, the magnetorheological fluid concentrate comprises about 90% to about 99.9% by weight iron powder, about 0.1% to about 10% by weight rust inhibiting agent and about 0.1% to about 5% by weight, water-soluble thixotropic agent.

DETAILED DESCRIPTION OF THE INVENTION

The present invention is directed to a magnetorheological fluid concentrate or instant magnetorheological fluid mix which can be used to form a magnetorheological fluid. The concentrate is a mixture of substantially dry powders that will form a magnetorheological fluid upon the addition of a carrier fluid such as water or oil. In particular, the magnetorheological fluid concentrate of the invention comprises a substantially dry mixture of a magnetic-responsive powder and a thixotropic agent. The term "substantially dry" means that the powders generally will have less than about 2% by weight water or moisture. In a preferred embodiment, the powders will have less than about 0.5% by weight moisture. Thus, the concentrate or instant mix of the invention does not contain a significant liquid component and is prepared without addition of a fluid or liquid. The substantial absence of liquid in the concentrate of the invention allows for easy transport of the concentrate to the end user.

The instant magnetorheological fluid mix is prepared by mixing or dispersing the dry thixotropic agent in the magnetic-responsive powder prior to transporting the magnetorheological fluid concentrate to the location of the end user. The combination of dry ingredients can then be easily mixed in a carrier fluid such as water or oil for use as a magnetorheological fluid. In an alternative embodiment, the magnetorheological fluid concentrate may contain the magnetic-responsive particles only, with the thixotropic agent added later by the end user prior to forming the magnetorheological fluid. In a further alternative embodiment, the concentrate may contain all the components of a magnetorheological fluid such as the thixotropic agent, except the magnetic-responsive powder, which powder is added at the time the magnetorheological fluid is formed.

The magnetic-responsive powder useful in the present invention may be any powder known to exhibit magnetorheological activity. In a preferred embodiment, the magnetic-responsive powder is iron powder. The iron powder may be any form of powdered iron, particularly carbonyl iron, reduced carbonyl iron, potato iron, crushed iron, milled iron, melt-sprayed iron, iron alloys or mixtures of any of the foregoing. In the most preferred embodiment, the iron will be reduced carbonyl iron.

The particle size of the magnetic-responsive powder should be selected so that it exhibits multi-domain characteristics when subjected to a magnetic field. Average particle diameter sizes for the magnetic-responsive powder are generally between about 0.1 micron and about 100 microns, preferably between about 0.5 micron and about 50 microns. In the most preferred embodiment, the average particle diameter size of the magnetic-responsive powder is about 1 micron to about 10 microns.

The magnetic-responsive powder is present in the magnetorheological fluid concentrate in an amount of about 90% to about 99.9% by weight, preferably in an amount of about 95% to about 99% by weight.

The thixotropic agent is any agent which can mixed or dispersed in a substantially dry form with the magnetic-responsive powder and which provides thixotropic rheology when hydrated. The thixotropic agent is selected based on the desired carrier fluid. For example, the thixotropic agent should be water-soluble if the magnetorheological fluid will be formed by adding an aqueous fluid to the substantially dry mix. Magnetorheological fluids formed from the magnetorheological fluid concentrates of the invention which utilize water-soluble thixotropic agents are easily mixed and avoid problems with clumping, as is sometimes seen with aqueous magnetorheological fluids.

The water-soluble thixotropic agent may be selected from natural or synthetic water-soluble gums and resins, starches, polysaccharides, cellulose derivatives, sodium tetraborate decahydrate, water-soluble metal soaps or mixtures of any of the foregoing. Additional materials which may be utilized as the water-soluble thixotropic agent of the present invention include seaweed extracts such as agar, algin, carrageenan, fucoidan, furcellaran, laminarin, hypnean, porphyran, funoran, dulsan, iridophycan or other seaweed hydrocolloids; plant exudates such as gum arabic, gum ghatti, gum karaya and gum tragacanth; seed gums such as guar gum, locust bean gum, quince seed gum, psyllium seed gum, flax seed gum, okra gum and tamarind; plant extracts such as larch arabinogalactan and pecrin; animal extracts such as chitin, gelatin and hydrolyzed collagen; and derivatives of the above such as sodium salts of the above or such compounds as propylene glycol alginate. Other materials which may be used include biosynthetic gums such as xanthan gum, deacetylated xanthan gum, carboxymethyl ether of xanthan gum, propylene glycol ester of xanthan gum, cationic derivatives of xanthan gum, formaldehyde cross-linked derivatives of xanthan gum, yeast polysaccharides, fungal polysaccharides, scleroglucan and dextrans; starch fractions and derivatives such as starch amylose, starch amylopectin, starch dextrins, starch hydroxyethyl ethers and other starch ethers; cellulose derivatives such as methylcellulose and its derivatives, hydroxyalkyl derivatives of cellulose, ethylhydroxyethylcellulose, sodium carboxymethylcellulose, hydroxymethylcellulose, methylhydroxyethylcellulose, hydroxypropylcellulose, hydroxyethylcellulose and cellulose gum sodium carboxymethylcellulose; synthetic resins such as polyethylene imines, polyacrylamide, polyvinyl alcohol, water reducible acrylic resins, pyrrolidone based polymers, polyvinylpyrrolidone, polyethylene oxide, polyethyleneimine polymers, water reducible epoxy esters, hexamethoxy-methyl melamine, isobutylene-butene copolymers, water soluble phenolic resins and other water soluble synthetic resins; and mixtures of any of the above such as xanthan gum and locust bean gum, xanthan gum and polyethyleneoxide and other mixtures.

Preferred materials for use as the water-soluble thixotropic agent include the sodium salt of carboxymethylcellulose, polyethylene oxide or xanthan gum.

Synthetic and natural clays may also be used as the thixotropic agent in magnetorheological fluid concentrates of the present invention. Synthetic hectorite is a preferred synthetic clay for use in such concentrates.

In aqueous systems, the carrier fluid is water or a water-based fluid. The water added to the magnetorheological fluid concentrate may be in any form and may be derived from any source, but is preferably both deionized and distilled before use in the magnetorheological fluid material. The water typically is utilized in an amount ranging from about 50 to about 95% by volume of the total magnetorheological fluid material. Preferably, the water is used in an amount ranging from about 52 to about 70% by volume of the total magnetorheological fluid material. This corresponds to about 11 to about 70%, preferably about 12 to about 24% by weight of the total magnetorheological fluid material. If there is too much water, the force output of the magnetorheological fluid can be insufficient for utilization in devices. If there is an insufficient amount of water, the magnetorheological fluid material can turn into a paste-like material.

In one embodiment of the invention, water alone is used. In other embodiments, small amounts of polar, water-miscible organic solvents such as methanol, ethanol, propanol, dimethyl sulfoxide, dimethyl formamide, ethylene carbonate, propylene carbonate, acetone, tetrahydrofuran or diethyl ether may be added. These solvents are preferably present in an amount of less than 5% by weight of the total formulation.

In another embodiment, the pH of the aqueous carrier fluid can be modified by the addition of acids or bases. A suitable pH range is between about 5 and about 13, and a preferred pH range is between about 8 and about 9.

If the magnetorheological fluid concentrate is used in an aqueous system, it may be desirable to employ an anti-freeze component to prevent freezing and to extend the usable temperature range of the magnetorheological fluid formed from the concentrate. Preferably, a glycol compound will be employed as an additive to the water to obtain such anti-freeze properties. Glycol compounds useful for preventing freezing are known, and examples of glycol compounds include ethylene glycol and propylene glycol, with ethylene glycol being preferred. The glycol compound, if utilized, is typically employed in an amount ranging from about 1 to about 70%, preferably from about 10 to about 50% by weight, based on the total weight of the water utilized in the magnetorheological fluid material.

If the magnetorheological fluid is formed with a carrier fluid which is an organic fluid, a thixotropic agent compatible with such a system may be selected. Oil-soluble metal soaps are preferred but other thixotropic agents useful for such organic fluid systems may be used. Some useful thixotropic agents are described in U.S. Pat. No. 5,645,752, incorporated herein by reference in its entirety. Such thixotropic agents include polymer-modified metal oxides. The polymer-modified metal oxide can be prepared by reacting a metal oxide powder with a polymeric compound that is compatible with the carrier fluid and capable of shielding substantially all of the hydrogen-bonding sites or groups on the surface of the metal oxide from any interaction with other molecules. Illustrative metal oxide powders include precipitated silica gel, fumed or pyrogenic silica, silica gel, titanium dioxide, and iron oxides such as ferrites or magnetites. Examples of polymeric compounds useful in forming the polymer-modified metal oxides include siloxane oligomers, mineral oils and paraffin oils, with siloxane oligomers being preferred. The metal oxide powder may be surface-treated with the polymeric compound through techniques well known to those skilled in the art of surface chemistry. A polymer-modified metal oxide, in the form of fumed silica treated with a siloxane oligomer, can be commercially obtained under the trade names AERO-SIL R202 and CABOSIL TS-720 from DeGussa Corporation and Cabot Corporation, respectively.

The carrier fluid used to form a magnetorheological fluid from the concentrate of the invention which contains a thixotropic agent useful in organic fluid carrier systems may be any of the vehicles or carrier fluids known for use with magnetorheological fluids. The organic fluids which may be used include silicone copolymers, white oils, hydraulic oils, chlorinated hydrocarbons, transformer oils, halogenated aromatic liquids, halogenated paraffins, diesters, polyoxyalkylenes, perfluorinated polyethers, fluorinated hydrocarbons, fluorinated silicones, hindered ester compounds, synthetic hydrocarbon oils such as polyalpha olefins and mixtures or blends thereof Particularly preferred are synthetic hydrocarbon oils such as polyalpha olefins.

The thixotropic agent will be present in the magnetorheological fluid concentrate in an amount from about 0.1% by weight to about 5% by weight. In a preferred embodiment, the thixotropic agent will be present in the magnetorheological fluid concentrate in an amount from about 0.5% by weight to about 2% by weight.

In order to inhibit the formation of rust on the surface of the magnetic-responsive powder in an aqueous system, particularly powder that includes iron, it is preferred to utilize a rust inhibitor as an additive to the magnetorheological fluid concentrate. Rust inhibitors, also known as oxygen scavengers, are well known and typically comprise various nitrite or nitrate compounds. Specific examples of rust inhibitors include sodium nitrite, sodium nitrate, sodium benzoate, borax, ethanolamine phosphate, and mixtures thereof. Descriptions of various rust inhibitors may be found in Uhlig et al., "Corrosion and Corrosion Control," Third Ed., John Wiley (1985); Collie, ed., "Corrosion Inhibitors," Noyes Data Corp. (1983); Ash et al., "Handbook of Industrial Chemical Additives," VCH Publications, New York (1991), pp. 783–785; McCutcheon's "Volume 2: Functional Materials, North American Edition," Mfg. Confectioner Publ. Co. (1992), pp. 73–84; and Diamant, "Rust and Rot," Argus and Robertson, London (1972), p. 59.

The rust inhibitor, if utilized, is typically employed in an amount ranging from about 0.1% to 10% by weight, preferably from about 1 to about 5% by weight based on the total weight of the water utilized in the magnetorheological fluid. The rust inhibitor generally is used in a powder form and is mixed with the other components of the concentrate by mechanical means.

Other components may optionally be included in the magnetorheological fluid concentrate of the invention. For example, alkalizing agents such as sodium hydroxide may be added to insure that the pH of the magnetorheological fluid formed from the magnetorheological fluid concentrate remains alkaline throughout its life. Anti-friction or anti-wear agents such as graphite or molybdenum disulfide may be included to decrease wear when the resulting magnetorheological fluid is in moving contact with surface of various parts. Other optional components include colorants and a desiccant to keep the magnetorheological fluid concentrate substantially dry until its use to form a magnetorheological fluid. Abrasive media such as cerium oxide optionally may be added so that the final magnetorheological fluid may be used as a magnetically controlled material for grinding, polishing or lapping.

The magnetorheological fluids made from the magnetorheological fluid concentrates of the present invention may be used in a number of devices, including brakes, pistons, clutches, dampers, exercise equipment, controllable composite structures and structural elements. In addition, the invention may be used in toys, games or novelties. In some devices, such as a magnetorheological brake, the magnetorheological fluid concentrate may function as a magnetically responsive medium without addition of a carrier fluid. One of skill in the art will understand which applications will require a magnetorheological fluid, e.g., a device where fluid flow is required, such as a magnetorheological hydraulic damper.

The magnetorheological fluid concentrate of the present invention is prepared by mechanically mixing the components so that a uniform powder mixture is obtained. Once the magnetic-responsive powder and thixotropic agent are mixed, the magnetorheological fluid concentrate formed may be shipped to the end user. This allows for great savings in transportation costs since the concentrate contains substantially no liquid component and weighs much less and takes up less room than known magnetorheological fluids. Once the end user is ready to use a magnetorheological fluid, a carrier fluid such as water is added to the concentrate to form a stable magnetorheological fluid which does not clump or settle. In this way, the carrier fluid need only be added just prior to the use of the magnetorheological fluid obtained. Alternatively, a water/glycol mixture may be added instead of plain water. If an organic fluid system is preferred, organic fluid compatible thixotropic additives may be used and an appropriate carrier fluid added.

The magnetorheological fluids which are made from the concentrates of the invention can be made by any of a variety of conventional mixing methods. For example, for aqueous systems, to the instant magnetorheological fluid mix or concentrate is added water which is mixed first by stirring with a spatula and then by vigorously shaking the container in which the magnetorheological fluid in provided. Alternatively, the shaking may be replaced with stirring with a small, high speed mechanical mixer. While not wishing to be bound by any theory, it is believed that the clumping found with aqueous magnetorheological fluids of the prior art is avoided because the thixotropic agent is dispersed or mixed in a substantially dry form with the magnetic-responsive powders prior to hydration in water. The concentrates of the invention can be mixed by similar means with other carrier fluids.

The magnetorheological fluids which are obtained from the instant magnetorheological fluid mixes of the present invention exhibit typical magnetorheological fluid behavior.

The following examples are given to illustrate the invention and should not be construed to limit the scope of the invention.

EXAMPLE 1

A magnetorheological fluid concentrate was prepared by mixing 100 grams of iron powder, ISP R2430 reduced carbonyl iron, 3 grams carboxymethylcellulose, sodium salt, and 3 grams of sodium nitrite. The dry ingredients were mechanically mixed so that a uniform powder mixture was obtained. The instant magnetorheological fluid mix thus formed was then made into a functioning magnetorheological fluid by adding 25 ml of water in a small bottle. The fluid was then mixed first by stirring with a spatula and then by vigorous shaking of the bottle.

EXAMPLE 2

A magnetorheological fluid mix was prepared by mixing 100 grams of iron powder, ISP R2430 reduced carbonyl iron, 0.5 grams polyethylene oxide ("Moon Blob", Dynamic Development Co.) and 1 gram of sodium nitrite. The dry ingredients were mechanically mixed so that a uniform powder mixture was obtained. The instant magnetorheological fluid mix thus formed was then made into a functioning magnetorheological fluid by adding 25 ml of water in a small bottle. The fluid was then mixed first by stirring with a spatula and then by vigorous shaking of the bottle.

EXAMPLE 3

A magnetorheological fluid mix was prepared by mixing 100 grams of iron powder, ISP R2430 reduced carbonyl iron, 0.75 grams of synthetic hectorite (Laponite RD) and 0.75 grams of sodium nitrite. The dry ingredients were mechanically mixed so that a uniform powder mixture was obtained. The instant magnetorheological fluid mix thus formed was then made into a functioning magnetorheological fluid by adding 25 ml of water in a small bottle. The fluid was then mixed first by stirring with a spatula and then by vigorous shaking of the bottle.

While the invention has been described in detail and with reference to specific embodiments thereof, it will be apparent to one skilled in the art that various changes and modifications can be made without departing from the spirit and scope thereof.

I claim:

1. A magnetorheological fluid concentrate comprising a substantially dry mixture of a magnetic-responsive powder and a synthetic or natural clay thixotropic agent, wherein the magnetic responsive powder is iron powder.

2. The magnetorheological fluid concentrate of claim 1 wherein said magnetic-responsive powder is iron powder selected from carbonyl iron, reduced carbonyl iron, potato iron, crushed iron, milled iron, melt-sprayed iron, iron alloys and mixtures thereof.

3. The magnetorheological fluid concentrate of claim 1 further comprising a rust-inhibiting agent.

4. The magnetorheological fluid concentrate of claim 1 wherein the iron powder is carbonyl iron, reduced carbonyl iron, potato iron, crushed iron, milled iron, melt-sprayed iron, iron alloys or mixtures thereof.

5. The magnetorheological fluid concentrate of claim 1 further comprising a rust-inhibiting agent.

6. The magnetorheological fluid concentrate of claim 5 wherein the rust inhibiting agent is sodium nitrite, sodium nitrate, sodium benzoate, borax, ethanolamine phosphate or mixtures thereof.

7. A magnetorheological fluid concentrate comprising a substantially dry mixture of a magnetic-responsive powder and a water-soluble thixotropic agent, wherein the thixotropic agent is a sodium salt of carboxymethylcellulose, polyethylene oxide or xanthan gum.

8. The magnetorheological fluid concentrate of claim 7 further comprising a rust-inhibiting agent.

9. The magnetorheological fluid concentrate of claim 8 wherein the rust inhibiting agent is sodium nitrite, sodium nitrate, sodium benzoate, borax, ethanolamine phosphate or mixtures thereof.

10. The magnetorheological fluid concentrate of claim 7 further comprising one or more of an alkalizing agent, an anti-friction agent, a colorant or a desiccant.

11. A magnetorheological fluid concentrate comprising a substantially dry mixture of a magnetic-responsive powder, a thixotropic agent, a rust-inhibiting agent, and one or more of an alkalizing agent, an anti-friction agent, a colorant or a desiccant, wherein the magnetic-responsive powder is iron powder.

12. The magnetorheological fluid concentrate of claim 11 wherein the rust inhibiting agent is sodium nitrite, sodium nitrate, sodium benzoate, borax, ethanolamine phosphate or mixtures thereof.

13. The magnetorheological fluid concentrate of claim 11 wherein the thixotropic agent is water-soluble.

14. The magnetorheological fluid concentrate of claim 11 wherein the thixotropic agent is compatible with an organic fluid.

15. The magnetorheological fluid concentrate of claim 11 wherein the iron powder is carbonyl iron, reduced carbonyl iron, potato iron, crushed iron, milled iron, melt-sprayed iron, iron alloys or mixtures thereof.

16. The magnetorheological fluid concentrate of claim 11 wherein the rust inhibiting agent is sodium nitrite, sodium nitrate, sodium benzoate, borax, ethanolamine phosphate or mixtures thereof.

17. The magnetorheological fluid concentrate of claim 13 wherein the water-soluble thixotropic agent is a gum, resin, starch, polysaccharide, cellulose derivative, sodium tetraborate decahydrate, metal soap or a mixture thereof.

18. A magnetorheological fluid concentrate comprising a substantially dry mixture of about 90% to about 99.9% by weight iron powder, about 0.1% to about 10% by weight rust inhibiting agent and about 0.1% to about 5% by weight water-soluble thixotropic agent.

19. A process for preparing a stable magnetorheological fluid comprising mixing a magnetic-responsive powder and a thixotropic agent to form a substantially dry mixture, adding a carrier fluid, stirring the substantially dry mixture into the carrier fluid, and mixing the substantially dry mixture with the carrier fluid by vigorous shaking.

20. The process of claim 19 wherein the carrier fluid is water.

21. The process of claim 20 wherein the carrier fluid is added just prior to use of the magnetorheological fluid in a magnetorheological fluid device.

22. A magnetorheological fluid concentrate comprising in the substantial absence of a liquid, a substantially dry mixture of a magnetic-responsive powder and a thixotropic agent in an amount which provides thixotropic rheology when said concentrate is hydrated with a carrier fluid.

23. The magnetorheological fluid concentrate of claim 22 wherein the thixotropic agent is water-soluble.

24. The magnetorheological fluid concentrate of claim 22 wherein the thixotropic agent is compatible with an organic fluid.

25. The magnetorheological fluid concentrate of claim 23 wherein the w ater-soluble thixotropic agent is a gum, resin, starch, polysaccharide, cellulose derivative, sodium tetraborate decahydrate, metal soap or a mixture thereof.

26. The magnetorheological fluid concentrate of claim 25 wherein the water-soluble thixotropic agent is sodium salt of carboxymethylcellulose, polyethylene oxide or xanthan gum.

* * * * *